US005257963A

United States Patent [19]

Comfort

[11] Patent Number: 5,257,963

[45] Date of Patent: Nov. 2, 1993

[54] HANDLEBAR FOR AEROBIC EXERCISE EQUIPMENT

[75] Inventor: Michael J. Comfort, San Francisco, Calif.

[73] Assignee: Kirk Kley, Rockville, Md. ; a part interest

[21] Appl. No.: 937,183

[22] Filed: Aug. 31, 1992

[51] Int. Cl.[5] ..... A63B 71/00
[52] U.S. Cl. ..... 482/51; 482/52
[58] Field of Search ..... 482/41, 42, 62, 112, 482/111, 51-54, 57, 908

[56] References Cited

U.S. PATENT DOCUMENTS

| | | | |
|---|---|---|---|
| 3,707,285 | 12/1972 | Martin | 482/42 |
| 3,708,167 | 1/1973 | Potgieter | 482/41 |
| 3,874,657 | 4/1975 | Niebojewski | 482/62 |
| 4,776,581 | 10/1988 | Shepherdson | 482/54 |

*Primary Examiner*—Stephen R. Crow
*Attorney, Agent, or Firm*—Schwartz & Weinrieb

[57] ABSTRACT

In a foot-engaging aerobic exercise machine that has a pair of parallel handrails, a handlebar extending between the handrails is slidable along the handrails and rotatable to positions above and below the handrails. This enables a person exercising on the machine to adjust the height, location, and angle of the handlebar to the best position for support or balance to help the person attain proper exercising posture.

19 Claims, 2 Drawing Sheets

HANDLEBAR FOR AEROBIC EXERCISE EQUIPMENT

BACKGROUND OF THE INVENTION

This invention relates to exercise equipment, and more particularly to aerobic exercise apparatus that engages the feet of a person who is exercising.

Persons using stand-up exercising equipment, such as stair climbing machines and treadmills derive the most benefit from their efforts when they maintain proper posture while they exercise. They should maintain a neutral stance with their shoulders, hips, knees and ankles aligned. Achieving a neutral stance on many types of equipment is difficult when the equipment has fixed handrails. Because of the variations in height or variations in arm and leg length of different individuals, fixed handrails are often at the wrong height or angle for a specific individual. Attempts have been made to overcome the disadvantages of fixed handrails by providing exercising equipment with cross bars that slide along the handrails or that slide up and down vertically with respect to the foot engaging parts of such exercise equipment. It has also been proposed that fixed curved handrails be used for this purpose. However, none of these prior attempts provide hand balancing or support implements that are sufficiently variable in their orientation to the foot engaging parts of the equipment to satisfy the needs of a wide variety of different sized people.

OBJECTIVES OF THE INVENTION

Accordingly, it is an object of this invention to provide improved exercising equipment.

Another object is to provide aerobic exercising equipment with improved hand-engaged balancing and supporting devices.

A further object is to provide exercising equipment that has handrails with a crossbar that can be adjusted so that it is located above or below the handrails.

A still further object is to provide exercise equipment having handrails with hand held balancing and support devices that are adjustable with over a 360 degree range.

An additional object is to provide exercise apparatus with a rotatable handlebar that can be adjusted to different angles with respect to handrails on the apparatus.

Another object is to provide an adjustable handlebar for stand-up aerobic exercising equipment that is durable, comfortable to use, relatively inexpensive to manufacture, easily adjusted without tools, and that does not have defects found in similar prior art devices.

Other objects and advantages of the invention will be found in the specification and claims, and the scope of the invention will be set forth in the claims.

DESCRIPTION OF THE INVENTION

Figure 1:
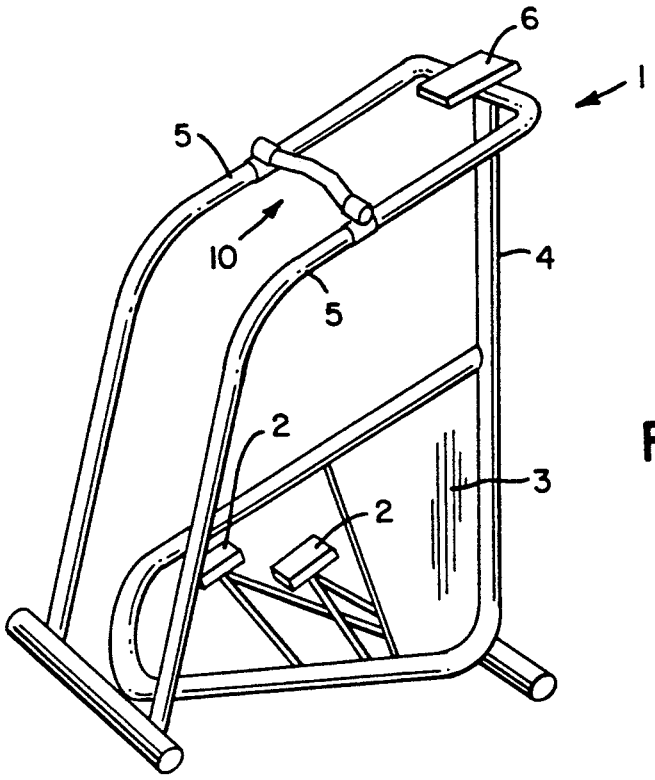
FIG. 1 is a perspective view of exercising equipment including an embodiment of this invention.
Figure 2:
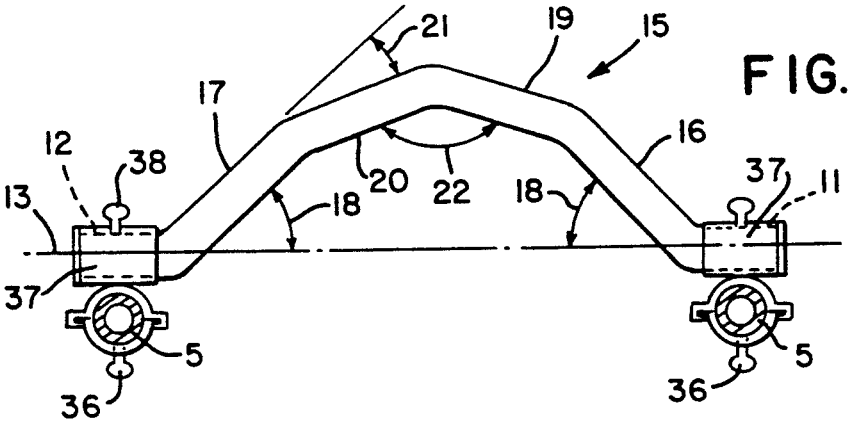
FIG. 2 is an enlarged elevational view of the handlebar shown in FIG. 1.

The drawing shows stand-up aerobic exercising apparatus 1 of the stair climbing type, such as Stair Master or Aero-Step. Such apparatus typically has a pair of pedals 2, each of which is adapted to be engaged by a foot of a person exercising on the apparatus. The pedals are connected to an operating mechanism 3, and the working parts are supported by a frame 4. The frame includes a pair of upwardly inclined parallel handrails 5 that lie in a common plane located vertically above the pedals 2. A control panel 6 may be provided. The specific details of the operating mechanism, control panel, pedals and stand are of machine 1 are not a part of this invention.

Figure 3:
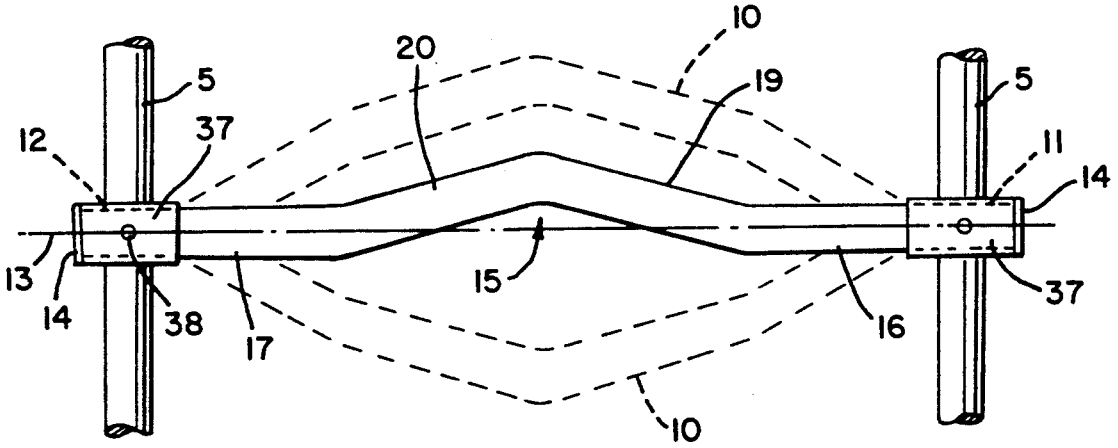
FIG. 3 is a top plan view of the handlebar shown in FIG. 2.
Figure 4:
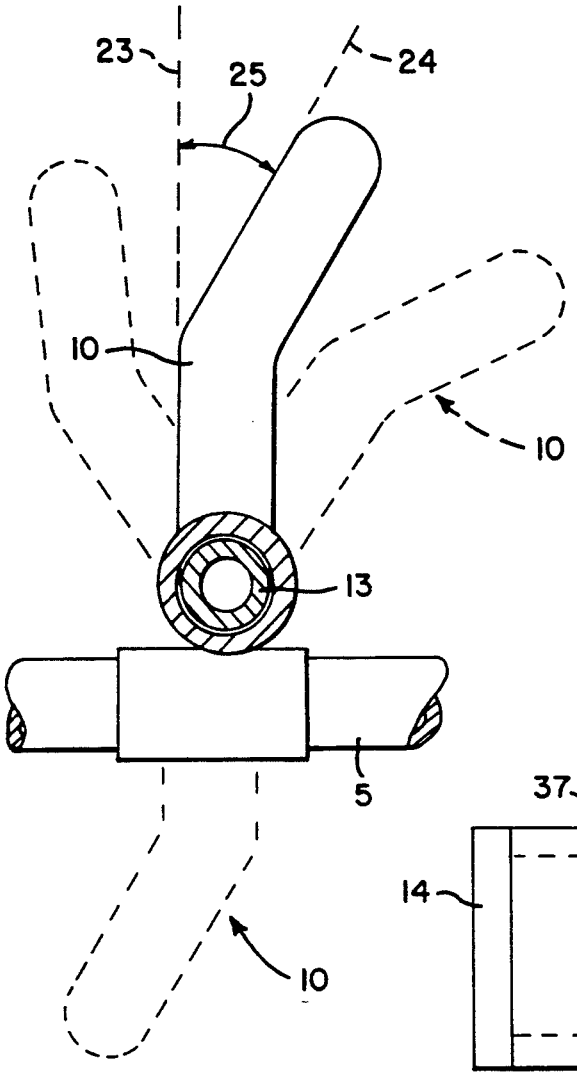
FIG. 4 is a side view of the handlebar shown in FIG. 2.
Figure 5:
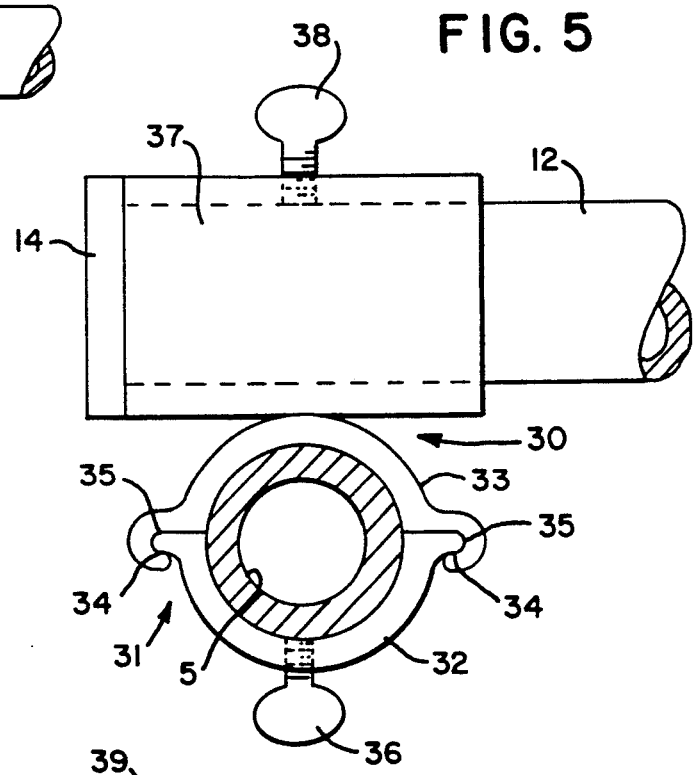
FIG. 5 is an enlarged view of the clamp.

This invention includes a one piece hollow rotatable handlebar 10 for helping a person using apparatus 1 to achieve correct posture while exercising. The handlebar 10 is circular in cross section and has a pair of identical right circular cylindrical terminal ends 11 and 12 that are aligned along a common central axis 13. As best seen in FIG. 3, axis 13 is perpendicular to both of the handrails 5. End caps 14 may be used to close ends 11 and 12 of the handlebar. The portion 15 of handlebar 10 between ends 11 and 12 intersects axis 13. Portion 15 may include a pair of first segments 16 and 17 each of which intersects axis 13 at a first acute angle 18 of about 45 degrees. Portion 15 may also include a pair of second segments 19 and 20, each of which intersects one of the first segments 16 or 17 at a second acute angle 21 of about 30 degrees. The second segments 19 and 20 may intersect each other at the center of the handlebar at an obtuse angle 22 of about one hundred and forty degrees. The pair of first segments 16 and 17 lie in a first predetermined first plane 23 indicated in phantom in FIG. 4 and the pair of second segments 19 and 20 lie in a predetermined second plane 24 indicated in phantom in FIG. 4. The first and second planes 23 and 24 intersect between terminal ends 11 and 12 at an angle 25 of about fifteen degrees. Portion 15 may be costed with soft plastic or rubber in the areas where it is to be gripped.

A pair of couplings 30 provide means for rotatably and slidably attaching handlebar 10 to the handrails 5. Each coupling 30 has a clamp member 31 that encircles one of the handrails. Each clamp member 31 has a lower clamp element 32 that is placed below a handrail 5 and upper clamp element 33 that is placed above the handrail. Element 33 defines a slot 34 on each side of its rail 5. Element 32 has a protruding bar 35 that extends along the entire length of element 32 at each of its terminal ends. The bars 35 slide into and mate with the slots 34 so as to hold clamp elements 32 and 33 together. One or more knob-headed set screws 36, each in tapped hole in an element 32, may be used to tighten clamp member 31 and prevent the handlebar 10 from sliding along the handrails 5. When screws 36 are loosened, handlebar 10 can be slid along the handrails 5 until it is at the best location on the handrail for the person using apparatus 1.

Each coupling 30 also includes a hollow cylindrical bearing member 37 that rotatably receives one of the ends 11 or 12 of handlebar 10. Bearing member 37 is attached to clamp member 33. Ends 11 and 12 are freely movable in bearing members 37, so handlebar 10 can be rotated 360 degrees around axis 13, as indicated in dotted lines in FIGS. 3 and 4. One or more knob-headed set screws 38, each in a tapped hole in a bearing 37, may be tightened against an end 11 or 12 to secure handlebar 10 in the rotational position selected by a person exercising on apparatus 1. As seen in phantom in FIG. 4, the angle of the handlebar 10 can be adjusted with respect to the common plane of handrails 5.

Figure 6:
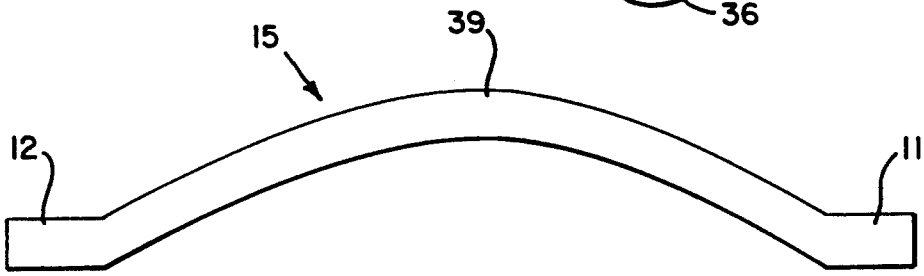
FIG. 6 is an elevational view of another embodiment of the invention.

FIG. 6 illustrates another embodiment of this invention that is identical to the embodiment shown in FIGS. 1–5 except that the shape of portion 15 between ends 11 and 12 is a continuous circular curve 39.

It has thus been shown that by the practice of this invention, a person exercising on a foot actuated aerobic machine 1 having handrails 5 can achieve correct exercising posture by using a handlebar 10 that has the maximum number of support or balance positions for the specific machine being used. Handlebar 10 may be slid along handrails 5 and then secured in place by clamps 31, and then the handlebar may be rotated to the specific vertical location above or below handrails 5 that is best for the person using the apparatus. When another person of different height or different length of limb uses the machine 1, loosening screws 36 and 38 enables such other person to quickly and easily move and adjust handlebar 10 to the best position for achieving support or balance. When handrails 5 slant upwardly as shown in FIG. 1, handlebar 10 can first be slid along the handrails until it is at the proper height for the individual using machine 1, and then screws 38 can be loosened and the handlebar adjusted to the perfect angle with respect to the hanfrails for that person.

While this invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of this invention.

What is claimed is:

1. In aerobic exercise apparatus having foot-engaging exercising means and a pair of parallel handrails located above said foot-engaging exercising means, the improvement in means for helping a person using said apparatus to achieve correct posture while exercising on said apparatus, said means consisting essentially of:

A. a handlebar having its opposite terminal ends aligned along an axis that is perpendicular to said parallel handrails, said handlebar having a portion between said terminal ends that intersects said axis; and B. means for slidably coupling said handlebar to said handrails comprising means rotatably receiving said terminal ends and permitting said handlebar to rotate with respect to said axis, whereby a person exercising on said apparatus can rotate said handlebar around said axis until said handlebar has the proper vertical location with respect to said foot-engaging exercising means for helping such person to attain correct exercising posture.

2. The improvement defined in claim 1, wherein said handlebar can be rotated to positions above and below said handrails.

3. The improvement defined in claim 2, wherein said handlebar can be rotated 360 degrees with respect to said axis.

4. The improvement defined in claim 1, wherein saidd means for coupling comprises clamping means at each of said terminal ends.

5. The improvement defined in claim 4, wherein said clamping means encircle said handrails.

6. The improvement defined in claim 1, wherein said portion of said handlebar that intersects said axis has a pair of first segments, each of which intersects said axis at an acute angle.

7. The improvement defined in claim 6, wherein said acute angle is about 45 degrees.

8. The improvement defined in claim 6, wherein said portion of said handlebar has a pair of second segments, each of which intersects one of said first segments at an angle of about 30 degrees.

9. The improvement defined in claim 1, wherein said portion of said handleber that intersects said axis has a pair of first segments which lie in a predetermined first plane, said portion of said handlebar has a pair of second segments which lie in a predetermined second plane, and said first and second planes intersect each other between said terminal ends.

10. The improvement defined in claim 9, wherein said first and second planes intersect each other at an angle of about 15 degrees.

11. The improvement defined in claim 1, wherein said portion of said handlebar is curved.

12. The improvement defined in claim 11, wherein said portion of said handlebar is a continuous curve.

13. The improvement defined in claim 1, wherein said handrails lie in a common plane and the angle at which said portion of said handlebar intersects said common plane can be adjusted by rotation of said handlebar.

14. Stand-up aerobic exercise apparatus comprising foot-engaging exercising means and a pair of parallel handrails located in a common plane above said foot-engaging exercising means, and means for helping a person using said apparatus to achieve correct posture while exercising on said apparatus, said means consisting essentially of:

A. rotatable one-piece handlebar having its opposite terminal ends aligned along an axis that is perpendicular to said parallel handrails, said handlebar being circular in cross section and having a portion between said terminal ends that intersects said axis; and B. means for coupling said handlebar to said handrails comprising means rotatably receiving said terminal ends and permitting said handlebar to rotate 360 degrees with respect to said axis, said means for coupling comprising clamping means that encircle said handrails at each of said terminal ends, and said means for coupling being slidable along said handrails; whereby a person exercising on said apparatus can rotate said handlebar around said axis and slide said handlebar along said handrails until said handlebar has the proper vertical location with respect to said foot-engaging exercising means and the proper angle with respect to said common plane for helping such person attain correct exercising posture.

15. The improvement defined in claim 14, wherein said portion of said handlebar that intersects said axis has a pair of first segments, each of which intersects said axis at first acute angle, and said portion has a pair of second segments, each of which intersects one of said first segments at a second acute angle, said pair of first segments lying in a predetermined first plane, said pair of second segments lying in a predetermined second plane, and said first and second planes intersecting each other between said terminal ends.

16. The improvement defined in claim 15, wherein said first segments each intersect said axis at an angle of about 45 degrees, said second segments each intersect one of said first segments at an angle of about 30 degrees, and said first and second planes intersect each other at an angle of about 15 degrees.

17. The improvement defined in claim 16, wherein said portion of said handlebar is curved.

18. The improvement defined in claim 17, wherein said portion of said handlebar is a continuous curve.

19. In aerobic exercise apparatus having foot-engaging exercising means and a pair of parallel handrails located above said foot-engaging exercising means, the improvement in means for helping a person using said apparatus to achieve correct posture while exercising on said apparatus, said means consisting essentially of:

A. a handlebar having its opposite terminal ends aligned along an axis that is substantially perpendicular to said parallel handrails, said handlebar having a portion between said terminal ends that intersects said axis; and B. means for slidably and rotatably coupling said handlebar to said handrails, whereby a person exercising on said apparatus can rotate said handlebar around said axis until said handlebar has the proper vertical location with respect to said foot-engaging exercising means for helping such person to achieve correct exercising posture.

* * * * *